US005462192A

United States Patent [19]

Pomroy et al.

[11] Patent Number: 5,462,192

[45] Date of Patent: * Oct. 31, 1995

[54] LUNCH HOLDER

[75] Inventors: James F. Pomroy, St. Paul; Eva M. Traxler, Minneapolis, both of Minn.

[73] Assignee: Plastics, Inc., St. Paul, Minn.

[ * ] Notice: The portion of the term of this patent subsequent to Jan. 11, 2011, has been disclaimed.

[21] Appl. No.: 251,894

[22] Filed: Jun. 1, 1994

Related U.S. Application Data

[63] Continuation of Ser. No. 168,670, Dec. 15, 1993, Pat. No. 5,323,926, which is a continuation of Ser. No. 874,902, Apr. 28, 1992, Pat. No. 5,277,329.

[51] Int. Cl.[6] ..... B65D 1/24

[52] U.S. Cl. ..... 220/526; 220/523; 206/541

[58] Field of Search ..... 206/470, 541, 206/542, 544, 545; 220/4.22, 4.23, 520, 521, 523, 526, 339, 524, 525; 229/2.5 R, 120.07

[56] References Cited

U.S. PATENT DOCUMENTS

| | | | |
|---|---|---|---|
| 33,946 | 12/1861 | Irwin | 206/541 |
| 324,443 | 8/1885 | Wilson | 220/520 |
| 1,661,728 | 3/1928 | La Rue | 220/523 |
| 1,933,894 | 11/1933 | Clink | 220/524 |
| 1,944,502 | 1/1934 | Factor | 220/524 |
| 2,339,580 | 1/1944 | Park | 206/544 |
| 2,457,043 | 12/1948 | Histand | 206/545 |
| 2,731,996 | 1/1956 | Hayes | 206/542 |
| 3,082,903 | 3/1963 | Stevens et al. | 220/339 |
| 3,372,690 | 3/1968 | Ruiz | 206/544 |
| 3,580,650 | 12/1968 | Morris | 229/2.5 R |
| 3,633,785 | 8/1969 | Cyr | 206/545 |
| 3,823,817 | 7/1974 | Hughes | 220/524 |
| 3,933,296 | 1/1976 | Ruskin et al. | 220/339 |
| 3,999,661 | 12/1976 | Jones | 229/2.5 R |
| 4,132,344 | 1/1979 | Jewell | 229/2.5 R |
| 4,412,616 | 11/1983 | Williams | 220/524 |
| 4,535,889 | 8/1985 | Terrands | 229/2.5 R |
| 4,653,685 | 3/1987 | Leary et al. | 229/2.5 R |
| 4,915,251 | 4/1990 | Payne | 229/2.5 R |
| 4,934,549 | 6/1990 | Allen | 220/520 |
| 4,951,866 | 8/1990 | Rusnak | 229/120.07 |
| 5,012,971 | 5/1991 | Cozzi et al. | 229/120.07 |
| 5,027,972 | 7/1991 | Bartholomew | 220/526 |
| 5,046,659 | 9/1991 | Warbarton | 229/2.5 R |
| 5,277,329 | 1/1994 | Pomroy et al. | 220/526 |
| 5,323,926 | 6/1994 | Pomroy et al. | 220/526 |

FOREIGN PATENT DOCUMENTS

| | | | |
|---|---|---|---|
| 337960 | 10/1989 | European Pat. Off. | 220/4.23 |
| 420429 | 4/1991 | European Pat. Off. | 220/520 |
| 1225103 | 9/1966 | Germany | 229/2.5 R |

*Primary Examiner*—David T. Fidei
*Attorney, Agent, or Firm*—Flehr, Hohbach, Test, Albritton & Herbert

[57] ABSTRACT

Lunch holder having first and second sections which are hingedly connected together along one side thereof in clam-shell fashion, a divider which separates one of the sections into a plurality of compartments for holding different food products, and a lid which is hingedly connected to the one section along a second side thereof for movement between covering and uncovering positions relative to the compartments. In one presently preferred embodiment, the two container sections, the divider and the lid are fabricated as a unitary structure of a semi-rigid plastic material.

14 Claims, 3 Drawing Sheets

LUNCH HOLDER

CROSS-REFERENCE TO RELATED APPLICATIONS

This is a continuation of Ser. No. 08/168,670, filed Dec. 15, 1993, now U.S. Pat. No. 5,323,926, which was a continuation of Ser. No. 07/874,902, filed Apr. 28, 1992, now U.S. Pat. No. 5,277,329.

BACKGROUND OF THE INVENTION

1. Field of the Invention

This invention pertains generally to food holders and, more particularly, to a lunch holder for carrying a plurality of food products.

2. Description of Related Art

Heretofore, a number of different types of carriers or containers have been utilized in packing and carrying lunches. These have included disposable carriers such as paper and plastic bags, cardboard boxes and the like, and more permanent carriers such as boxes fabricated of metal and/or plastic. With such carriers, a variety of containers have been utilized for holding different food products, such as sandwiches, potato chips, pickles, fruit, cookies and the like.

OBJECTS AND SUMMARY OF THE INVENTION

It is in general an object of the invention to provide a new and improved food holder which is particularly suitable for holding and carrying the types of food products which typically make up a lunch.

Another object of the invention is to provide a food holder of the above character which is light in weight and economical to manufacture.

These and other objects are achieved in accordance with the invention by providing a lunch holder having first and second sections which are hingedly connected together along one side thereof in clamshell fashion, a divider which separates one of the sections into a plurality of compartments for holding different food products, and a lid which is hingedly connected to the one section along a second side thereof for movement between covering and uncovering positions relative to the compartments. In one presently preferred embodiment, the two container sections, the divider and the lid are fabricated as a unitary structure of a semi-rigid plastic material.

DETAILED DESCRIPTION

Figure 1:
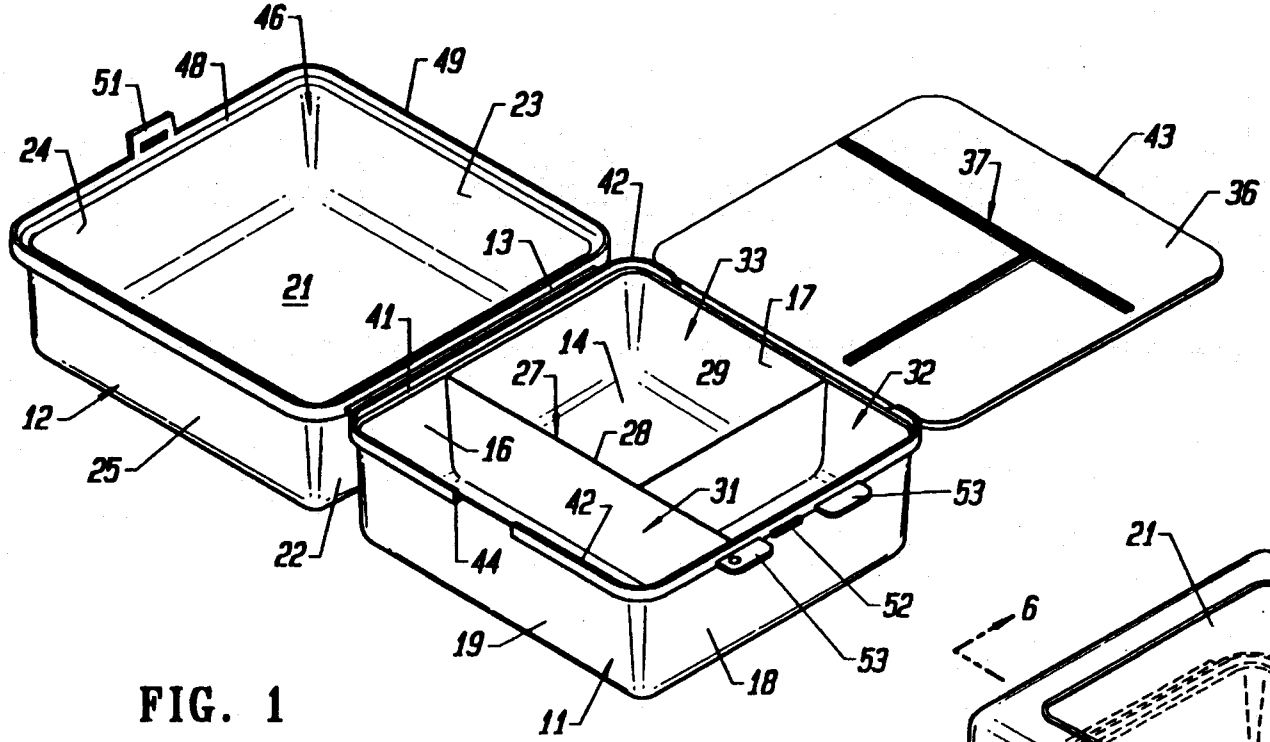
FIG. 1 is an isometric view of one embodiment of a lunch holder according to the invention in a open position.
Figure 2:
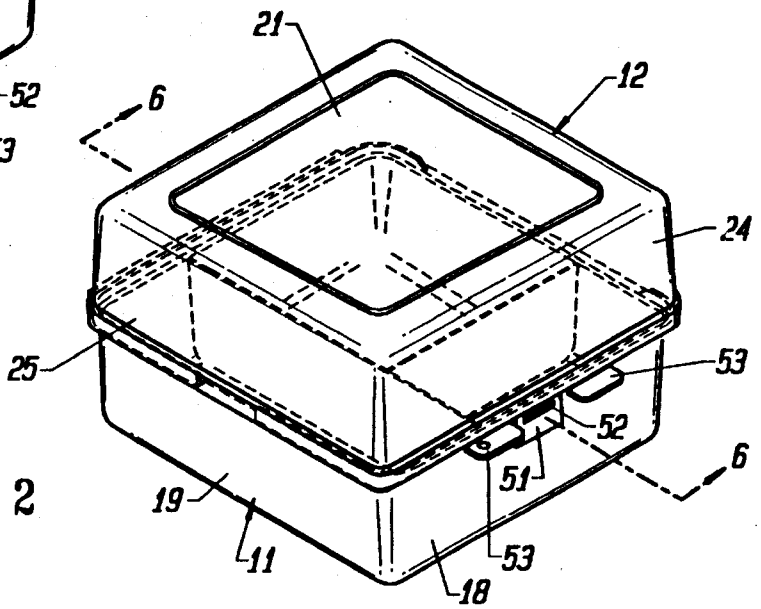
FIG. 2 is an isometric view of the embodiment of FIG. 1 in a closed position.
Figure 3:
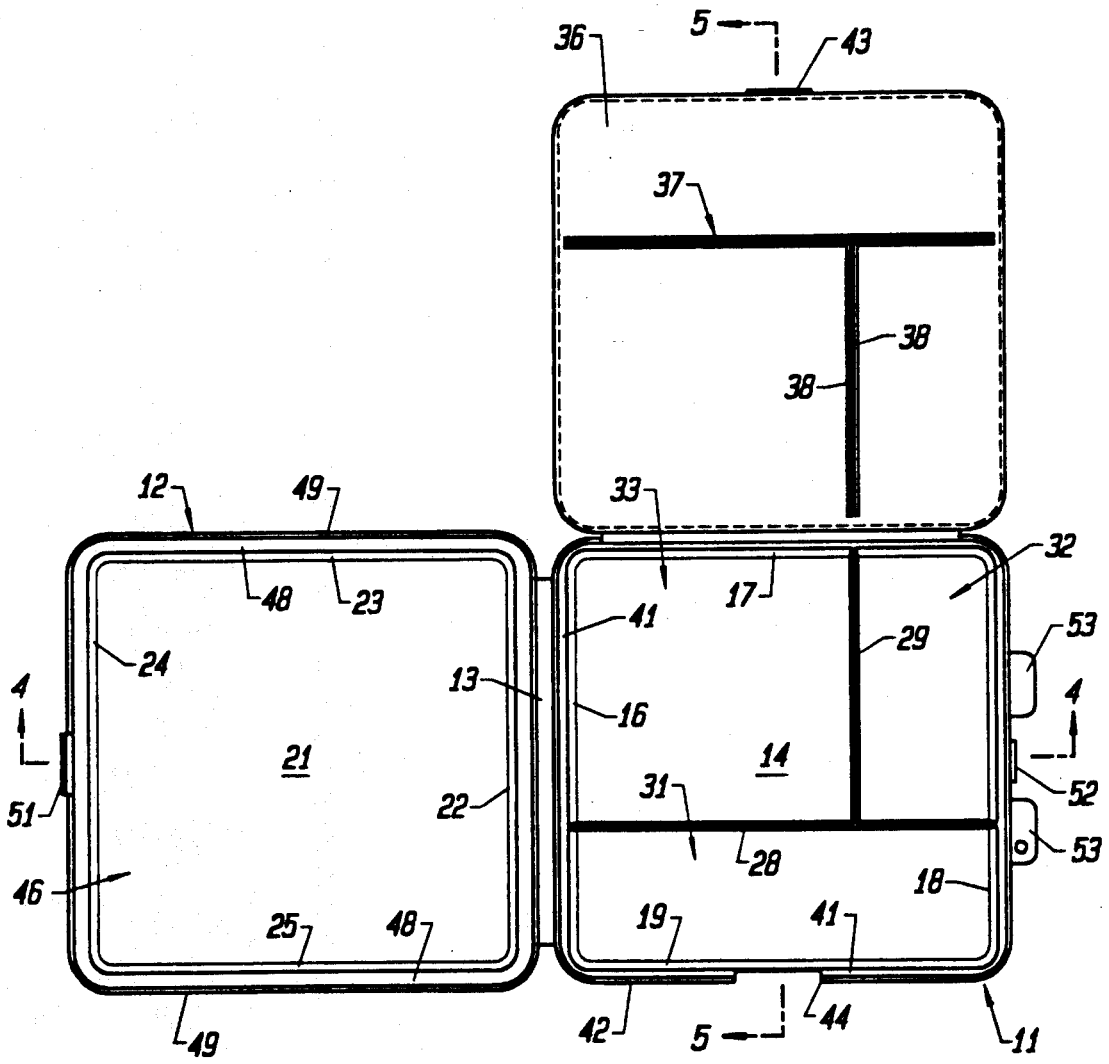
FIG. 3 is a top plan view of the embodiment of FIG. 1 in an open position.
Figure 4:
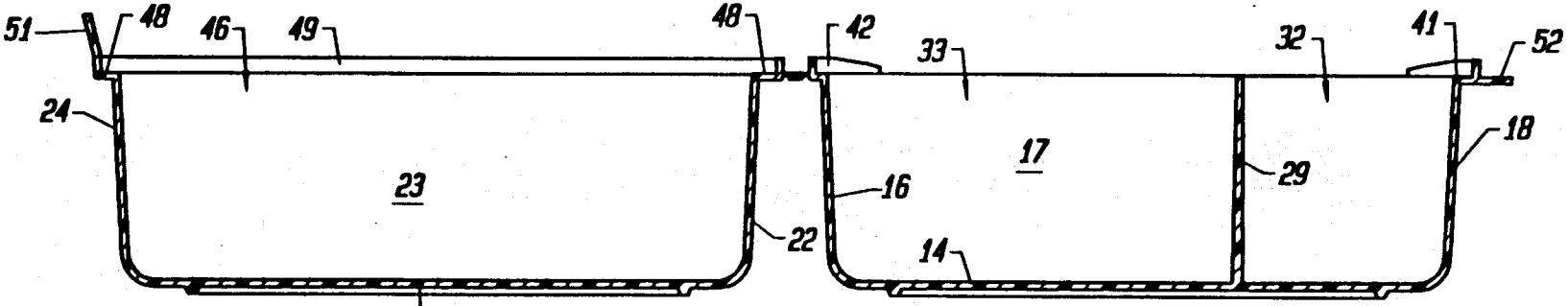
FIG. 4 is a cross-sectional view taken along line 4—4 in FIG. 3.
Figure 5:
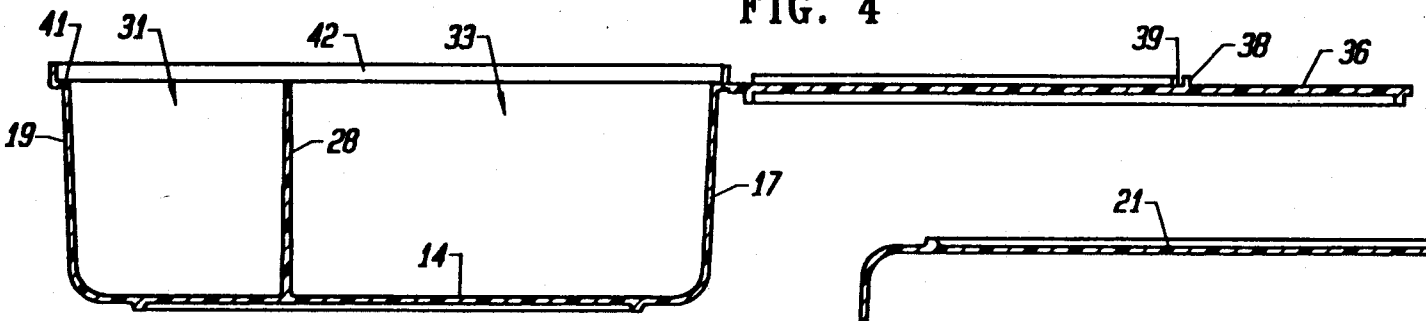
FIG. 5 is a cross-sectional view taken along line 5—5 in FIG. 3.
Figure 6:
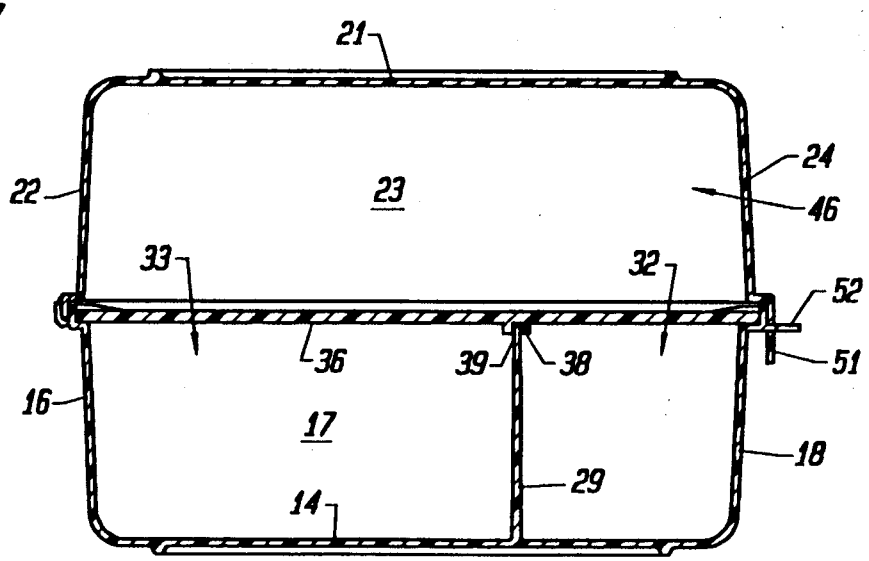
FIG. 6 is a cross-sectional view taken along line 6—6 in FIG. 2.

As illustrated in the drawings, the lunch holder has a base section 11 and a cover section 12 which are connected together along one side thereof in clamshell fashion by a hinge 13 for movement between an open position in which the two sections are positioned side-by-side as illustrated in FIG. 1 and a closed position in which the two sections are superposed with the cover section positioned above the base section as illustrated in FIG. 2.

The base section has a rectangular bottom wall 14 and side walls 16–19 which taper outwardly from the bottom wall by an angle on the order of 15 degrees. The top section has a wall 21 similar to bottom wall 14 and side walls 22–25 similar to walls 16–19. Even though wall 21 is actually on top when the cover section is inverted above the base section in the closed position, this wall is conveniently referred to as the bottom wall of the cover section since it is on the bottom when the cover section is in the open position.

The base section is divided into a plurality of compartments for holding different food products by a T-shaped partition 27 consisting of a relatively long panel 28 which extends between opposite side wall 16, 18, and a relatively short panel 29 which extends between the intermediate side wall 17 and the longer panel. The panels extend from bottom wall 14 to a height approximately even with the tops of side walls 16–19 and form one compartment 31 between the longer panel and side wall 19, and two additional compartments 32, 33 on opposite sides of the shorter panel.

A lid 36 is hingedly connected to the base section along the upper margin of side wall 17 for movement between covering (closed) and uncovering (open) positions relative to compartments 31–33. A seal 37 is provided on the lower side of the lid for engagement with the upper edge portions of the T-shaped partition when the lid is in the covering or closed position. This seal comprises spaced apart flanges 38 which define channels 39 in which the upper edge portions of the partition are received.

The lid seats against a shoulder or ledge 41 which projects horizontally in an outward direction from the upper margins of side walls 16–19, with an upstanding peripheral flange 42 along the outer edge of the shoulder in sealing engagement with the periphery of the lid when the lid is closed. Frictional engagement between the flange and lid holds the lid in the closed position, and a tab 43 projects laterally from the lid through a gap 44 in the peripheral flange on side wall 19 to facilitate lifting of the lid.

In the embodiment illustrated, cover section 12 has a single compartment 46 for holding larger food products such as a sandwich, and there is no lid for this compartment other than lid 36 in the base section. If desired, however, the cover section can be formed into a plurality of compartments and provided with a lid of its own. Similarly, the base section can be divided into any desired number of compartments with suitable partitions.

The cover section has a shoulder 48 which projects laterally from side walls 22–24 and abuts against the upper surface of flange 42 on the base section, and a peripheral skirt or flange 49 which extends from the outer margin of the shoulder and fits over the flange on the base section to seal the compartment in the cover section. The cover section is retained in its closed position by a catch 51 which extends from side wall 24 and engages a lug 52 on side wall 18. Tabs 53 project from side wall 18 on opposite sides of the lug and facilitate disengagement of the catch.

In one presently preferred embodiment, the entire lunch holder is fabricated as a unitary structure of a semi-rigid plastic material such a polypropylene by a suitable molding process.

In operation and use, cover section 12 and lid 36 are swung to their open positions, and food products such as potato chips, pickles and cookies are placed in compartments 31–33. Lid 36 is closed, sealing these compartments, and another food product such as a sandwich is placed on top of the lid. The cover section is then closed, sealing the sandwich in compartment 49, and catch 51 is engaged with lug 52 to hold the cover section in the closed position.

To open the container, the catch is disengaged from the lug, the cover section is swung to the side of the base section, the sandwich is removed, and the lid is opened to provide access to the food products in the base section. The catch is disengaged from the lug relatively easily by placing the thumb on top of one of the tabs 53, placing the forefinger beneath the catch, and lifting the catch away from the lug with the finger while the thumb bears down on the tab.

The lunch holder has a number of important features and advantages. It is light in weight, economical to manufacture, and easy to use. It is easily cleaned and can be used repeatedly to hold a variety of food products.

It is apparent from the foregoing that a new and improved lunch holder has been provided. While only certain presently preferred embodiments have been described in detail, as will be apparent to those familiar with the art, certain changes and modifications can be made without departing from the scope of the invention as defined by the following claims.

We claim:

1. In a lunch holder for holding and carrying a plurality of food products: first and second container sections of substantially similar shape and substantially equal size connected together in clamshell fashion along one side of each of said sections for movement between an open position in which the two sections are positioned side-by-side and a closed position in which the two sections are superposed one above the other, a divider separating the first section into a plurality of compartments for holding different food products, and a lid hingedly connected to the first section along a second side of said first section for movement between covering and uncovering positions relative to the compartments when the two sections are in the open position, said sections, said divider and said lid being a unitary molded structure of a semi-rigid plastic material.

2. The lunch holder of claim 1 including means forming a seal between the lid and the divider when the lid is in the covering position.

3. The lunch holder of claim 2 wherein the means forming a seal between the lid and the divider comprises a pair of spaced apart flanges on one side of the lid forming a channel in which an edge portion of the divider is received when the lid is in the covering position.

4. The lunch holder of claim 1 wherein the first section of the container has bottom and side walls, and the divider comprises a T-shaped partition having a first panel extending between opposing side walls of the first section and a second panel extending between the first panel and an intermediate side wall of the first section.

5. In a lunch holder for holding and carrying a plurality of food products: base and cover sections hingedly connected together in clamshell fashion along one side of each of said sections, said base and cover sections each having a generally square base wall and four side walls which taper outwardly from the base wall at an angle on the order of 15 degrees, a T-shaped partition dividing the base section into a plurality of compartments for holding different food products, a lid hingedly connected to the base section along a second side of the base section for movement between open and closed positions relative to the compartments, and a peripheral flange on the base section which is engaged by the lid when the lid is in the closed position.

6. The lunch holder of claim 5 wherein the base and cover sections, the T-shaped partition and the lid are a unitary molded structure of semi-rigid plastic.

7. A lunch holder having first and second sections of substantially similar size and shape which are hingedly connected together along one side thereof in clamshell fashion, said first and second sections each having a generally square base wall and four side walls of substantially similar size and shape which taper outwardly from the base wall at an angle on the order of 15 degrees, a divider which separates one of the sections into a plurality of compartments for holding different food products, and a lid which is hingedly connected to the one section along a second side thereof for movement between covering and uncovering positions relative to the compartments.

8. The lunch holder of claim 7 wherein the first and second sections, the divider and the lid are a unitary molded structure of semi-rigid plastic.

9. The lunch holder of claim 5 wherein the peripheral flange has a gap, and the lid has a tab which projects laterally through the gap to facilitate lifting of the lid when the lid is in the closed position.

10. In a lunch holder for holding and carrying a plurality of food products: first and second container sections connected together in clamshell fashion along one side of each of said sections for movement between an open position in which the two sections are positioned side-by-side and a closed position in which the two sections are superposed one above the other, each of said container sections having bottom and side walls, a divider separating the first section into a plurality of compartments for holding different food products, a lid hingedly connected to the first section for movement between covering and uncovering positions relative to the compartments when the two sections are in the open position, a shoulder extending laterally in an outward direction from the side wall of one of the sections, and a peripheral flange extending along an outer edge of the shoulder in a direction generally parallel to the side wall of the one section for laterally encompassing the lid when the lid is in the covering position and the two container sections are in the closed position.

11. In a lunch holder for holding and carrying a plurality of food products: first and second container sections of semi-rigid plastic connected together in clamshell fashion along one side of each of said sections for movement between an open position in which the two sections are positioned side-by-side and a closed position in which the two sections are superposed one above the other, a divider separating the first section into a plurality of compartments for holding different food products, a lid hingedly connected to the first section for movement between covering and uncovering positions relative to the compartments when the two sections are in the open position, a lug projecting in an outward direction from a side wall of one of the two sections, a catch extending from the other section for engagement with the lug to retain the two sections in the closed position, and a tab projecting laterally from one of the sections near the lug for engagement by a hand disengaging the catch from the lug, the lug, catch and tab being integral parts of the container sections.

12. The lunch holder of claim 11 wherein the catch extends from an edge portion of a side wall of the one section and is substantially coplanar with that side wall, said catch having a slotted opening in which the lug is received.

13. In a lunch holder for holding and carrying a plurality of food products: first and second container sections of similar size and shape connected together in clamshell fashion along one side of each of said sections for movement between an open position in which the two sections are positioned side-by-side and a closed position in which the two sections are superposed one above the other, said first and second sections each having a generally square base wall and four side walls which taper outwardly from the base wall at an angle on the order of 15 degrees, a divider separating the first section into a plurality of compartments for holding different food products, a lid hingedly connected to the first section for movement between covering and uncovering positions relative to the compartments when the two sections are in the open position, a lug projecting in an outward direction from a side wall of one of the two sections, a catch extending from the other section for engagement with the lug to retain the two sections in the closed position, and a pair of tabs projecting laterally from one of the sections on opposite sides of the lug for engagement by a hand disengaging the catch from the lug.

14. The lunch holder of claim 13 wherein the catch extends from an edge portion of a side wall of the one section and is substantially coplanar with that side wall, said catch having a slotted opening in which the lug is received.

* * * * *